US005594219A

United States Patent [19]

Kamani et al.

[11] Patent Number: 5,594,219

[45] Date of Patent: Jan. 14, 1997

[54] ELEVATOR POSITION APPARATUS

[75] Inventors: Sanjay Kamani, Unionville; Daniel S. Williams, Meridan; Christopher H. Koenig, Bristol, all of Conn.

[73] Assignee: Otis Elevator Company, Farmington, Conn.

[21] Appl. No.: 378,111

[22] Filed: Jan. 23, 1995

[51] Int. Cl.[6] ..... B66B 1/34

[52] U.S. Cl. ..... 187/394; 187/316; 187/283

[58] Field of Search ..... 187/291, 283, 187/394, 393, 391, 316

[56] References Cited

U.S. PATENT DOCUMENTS

| | | | |
|---|---|---|---|
| 4,362,224 | 12/1982 | Fairbrother | 187/29 |
| 4,750,592 | 6/1988 | Watt | 187/134 |
| 4,798,267 | 1/1989 | Foster et al. | 187/28 |
| 4,977,984 | 12/1990 | Arnosti et al. | 187/134 |

OTHER PUBLICATIONS

Patent application 8/292,645 filed Aug. 18, 1994 by E. Jamieson, C. Pietrzykowski and J. Izard entitled system for Position Loss Recovery for an Elevator Car.

8/536727 Andreas Jaehn Sep 29, 1995.

*Primary Examiner*—Robert Nappi

[57] ABSTRACT

An elevator position apparatus for determining if an elevator car is positioned within a door zone includes an encoded medium disposed vertically in an elevator hoistway, at least two door zone sensors for providing first and second door zone sensor signals in response to the encoded medium, at least two leveling sensors for providing up and down sensor signals in response to the encoded medium and means for determining if the elevator car is positioned within the door zone.

18 Claims, 6 Drawing Sheets

ELEVATOR POSITION APPARATUS

TECHNICAL FIELD

The present invention relates generally to elevators and, in particular, relates to elevator door zone detection.

BACKGROUND OF THE INVENTION

To stop an elevator smoothly and level with a sill, an elevator system must know when to initiate a stop, when to go into a leveling mode of operation, and when to begin opening the landing doors. Most elevators begin opening their doors two to three inches before the elevator car is actually level with the sill to speed-up passenger transfer. This area is known as a door zone. The elevator doors must not be opened when the elevator car is not within the door zone. It is therefore necessary to know the exact location of the elevator car at all times. As a consequence, elevator position devices are used to monitor elevator car position.

One existing elevator position device includes steel bars, vanes or magnets attached to a floating steel tape, running the length of the hoistway, and a hoistway position reader box mounted on the car which are used to monitor the car position. The steel bars, vanes or magnets are located on the steel tape with respect to their corresponding landing sills to mark the approximate distance from the door zone. The reader box contains sensors that sense the location of each steel bar, vane or magnet as the car travels up and down the hoistway such that the elevator system may determine if the elevator car is within the door zone corresponding to a particular landing. Two sensors are used to protect against a false door zone detection in the event that one sensor fails in an active state. The sensors are connected to an AND gate, the output of which is used to determine if the elevator car is within the door zone. For example, if both sensors are actuated (i.e., in the active state) the AND gate produces a logic "1" which represents the presence of a door zone and allows the elevator system to open the elevator doors.

Other techniques for determining if an elevator car is positioned within a door zone are sought, and it is to this end that the present invention is directed.

DISCLOSURE OF THE INVENTION

It is an object of the present invention to reduce the number of passenger entrapments caused by the inability to detect a door zone.

It is another object of the present invention to provide improved failure management and reduced elevator downtime caused by door zone detection errors.

It is yet another object of the present invention to provide error detection that facilitates scheduled maintenance.

According to the present invention, an elevator position apparatus for determining if an elevator car is positioned within a door zone includes an encoded medium disposed vertically in an elevator hoistway, at least two door zone sensors for providing first and second door zone sensor signals in response to the encoded medium, at least two leveling sensors for providing up and down sensor signals in response to the encoded medium and means for determining if the elevator car is positioned within the door zone. The means is responsive to the first and second door zone sensor signals and the up and down sensor signals. The means operates in accordance with the following algorithm:

Door Zone=(1LV and 2LV) or [(1LV or 2LV) and (UIS and DIS)], wherein Door Zone equals the value of a door zone signal which is indicative of the presence of the door zone; 1LV equals the value of the first door zone sensor signal; 2LV equals the value of the second door zone sensor signal; UIS equals the value of the up sensor signal; and DIS equals the value of the down sensor signal.

BEST MODE FOR CARRYING OUT THE INVENTION

Figure 1:
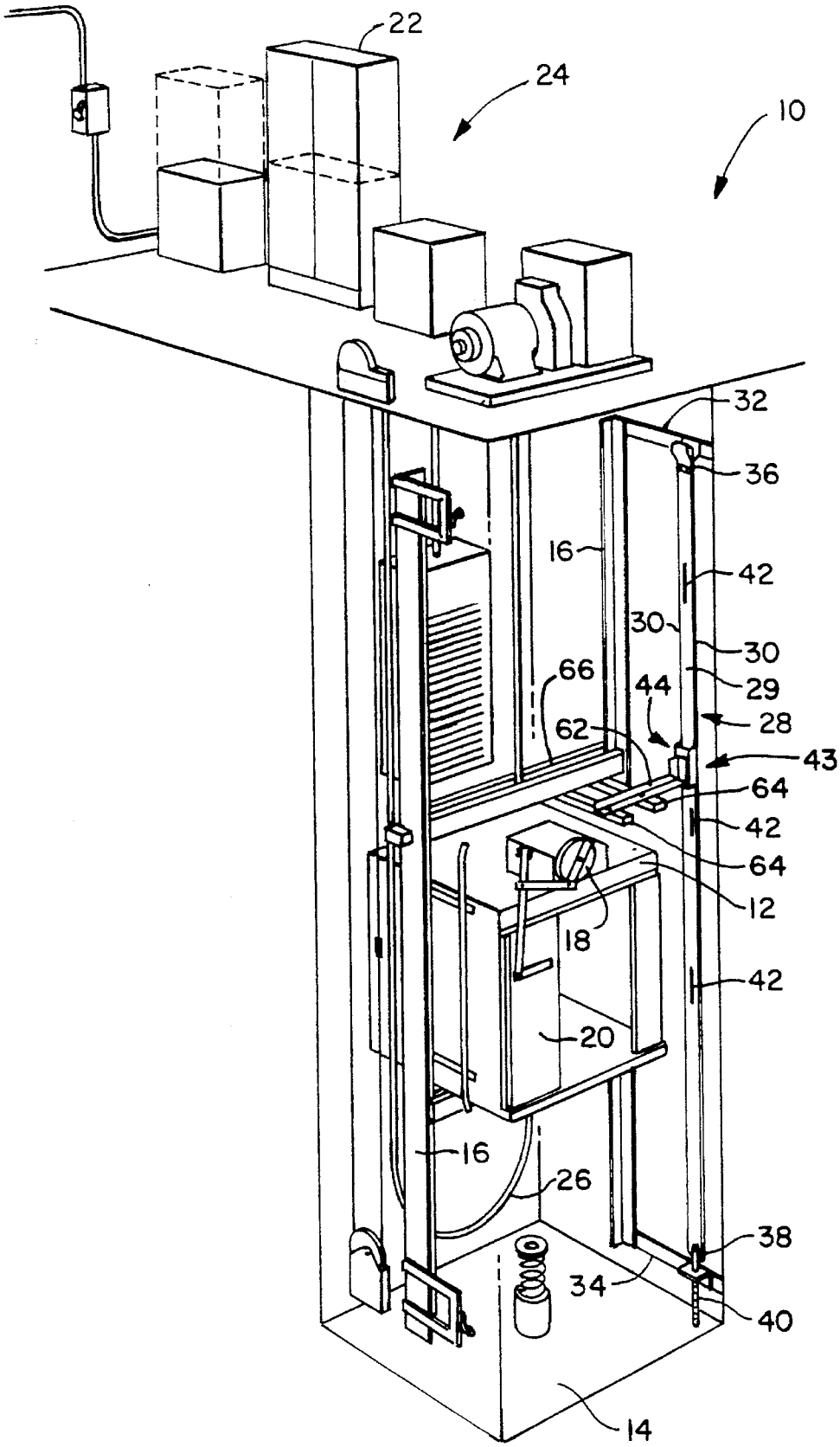
FIG. 1 is a perspective view of a elevator system incorporating a preferred embodiment of the present invention.

Referring to FIG. 1, an elevator system 10 employing a preferred embodiment of a elevator position apparatus is shown. An elevator car 12 is disposed in a hoistway 14 such that the elevator car 12 may travel along elevator guide rails 16 disposed vertically in the hoistway 14. A door operator 18 is disposed on the elevator car 12 so that the door operator 18 may open and close the elevator door(s) 20 as needed. An elevator controller 22 is disposed in a machine room 24 which monitors and provides system control of the elevator system 10. A traveling cable 26 is used to provide an electrical connection between the elevator controller 22 and electrical equipment in the hoistway 14. Of course, it should be realized that the present invention can be used in conjunction with other elevator systems including hydraulic and linear motor systems, among others.

A elevator position apparatus is used in conjunction with the elevator system 10 to accurately determine if the elevator car 12 is within a door zone. The elevator position apparatus includes an encoded medium 28, a decoding means 43 and a motion logic controller 82 for determining if an elevator car 12 is within a door zone.

Figure 2:
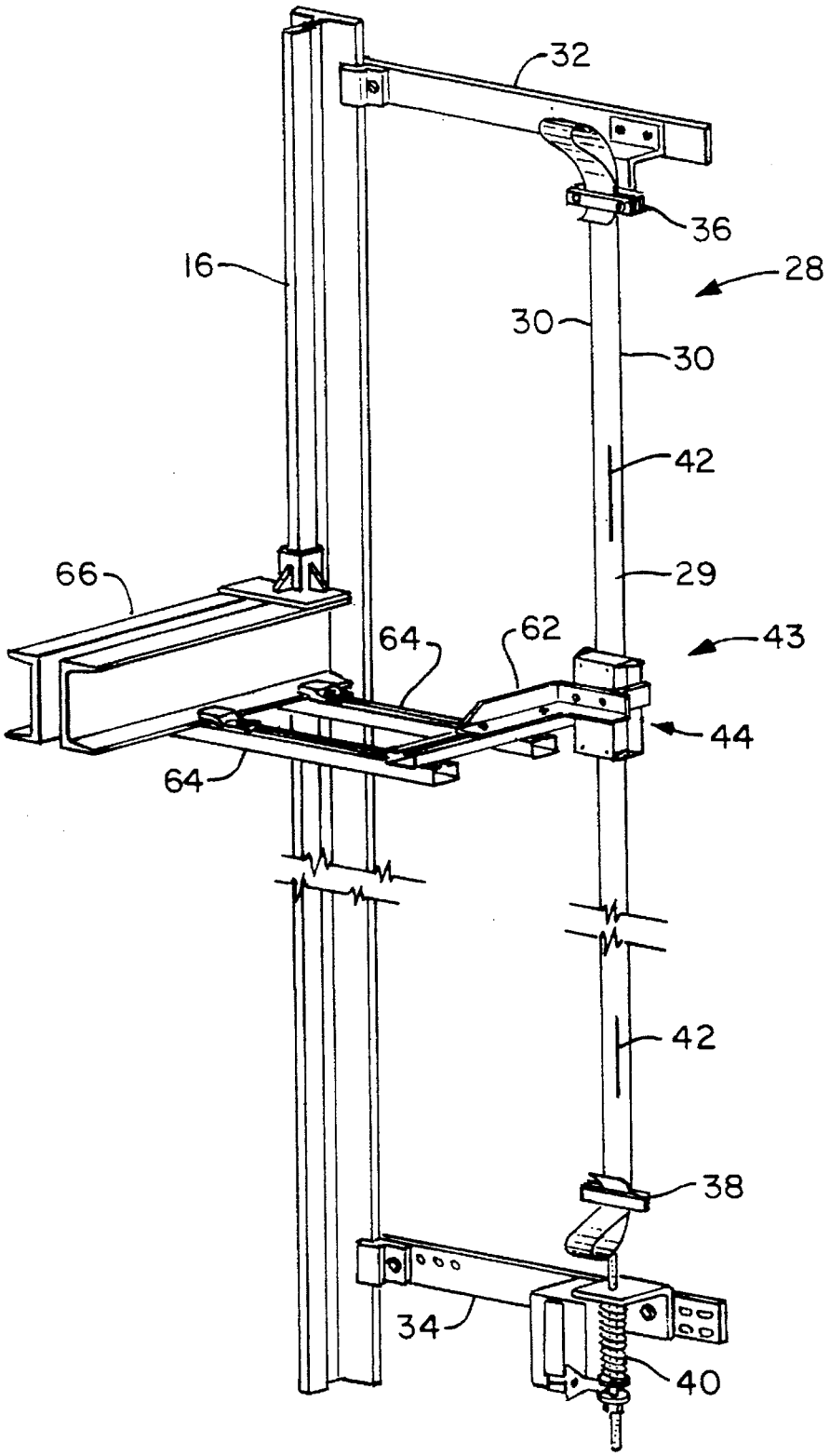
FIG. 2 is a magnified view of an encoded medium and a reader box of FIG. 1.
Figure 3:
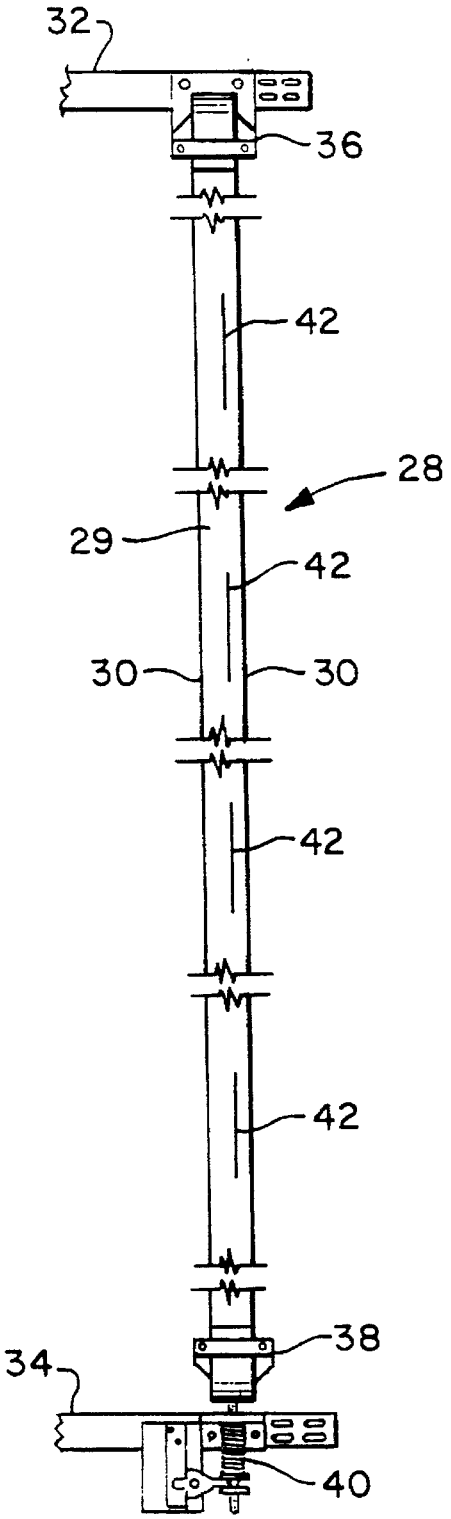
FIG. 3 is a front view of the encoded medium of FIG. 2.

Referring to FIGS. 2 and 3, a preferred embodiment of the encoded medium 28 is shown which includes a steel tape 29, having outer edges 30, disposed vertically in the hoistway 14. The steel tape 29 is attached to upper and lower horizontal supports 32, 34 by upper and lower tape hitches 36, 38 respectively. The upper and lower supports 32, 34 provide vertical support to the steel tape 29 and are attached to the guide rails 16. Additionally, a spring 40 is used in conjunction with the lower hitch 38 for providing tension in the steel tape 29. It should be understood by one skilled in the art that other suitable encoded mediums can be used without departing from the spirit and scope of the present invention.

The encoded medium 28 may be encoded using various methods. For example, optical or mechanical encoding methods can be used. In a preferred embodiment, the encoded medium 28 is encoded by conventionally disposing magnets 42, as is known in the art, on the steel tape 29 in predetermined positions. The magnets 42 are located on the steel tape 29 with respect to their corresponding hoistway landings (not shown) to mark the appropriate door zone. In a preferred embodiment, the steel tape 29 includes one magnet 42 for each landing. Preferably, each magnet 42 is positioned in the same vertical plane along the steel tape 29 and each magnet 42 is 165 mm in vertical length. Various changes to the above description of the length and position of the magnets 42 may be made without departing from the spirit and scope of the present invention as would be obvious to one of ordinary skill in the art of the present invention.

Figure 4:
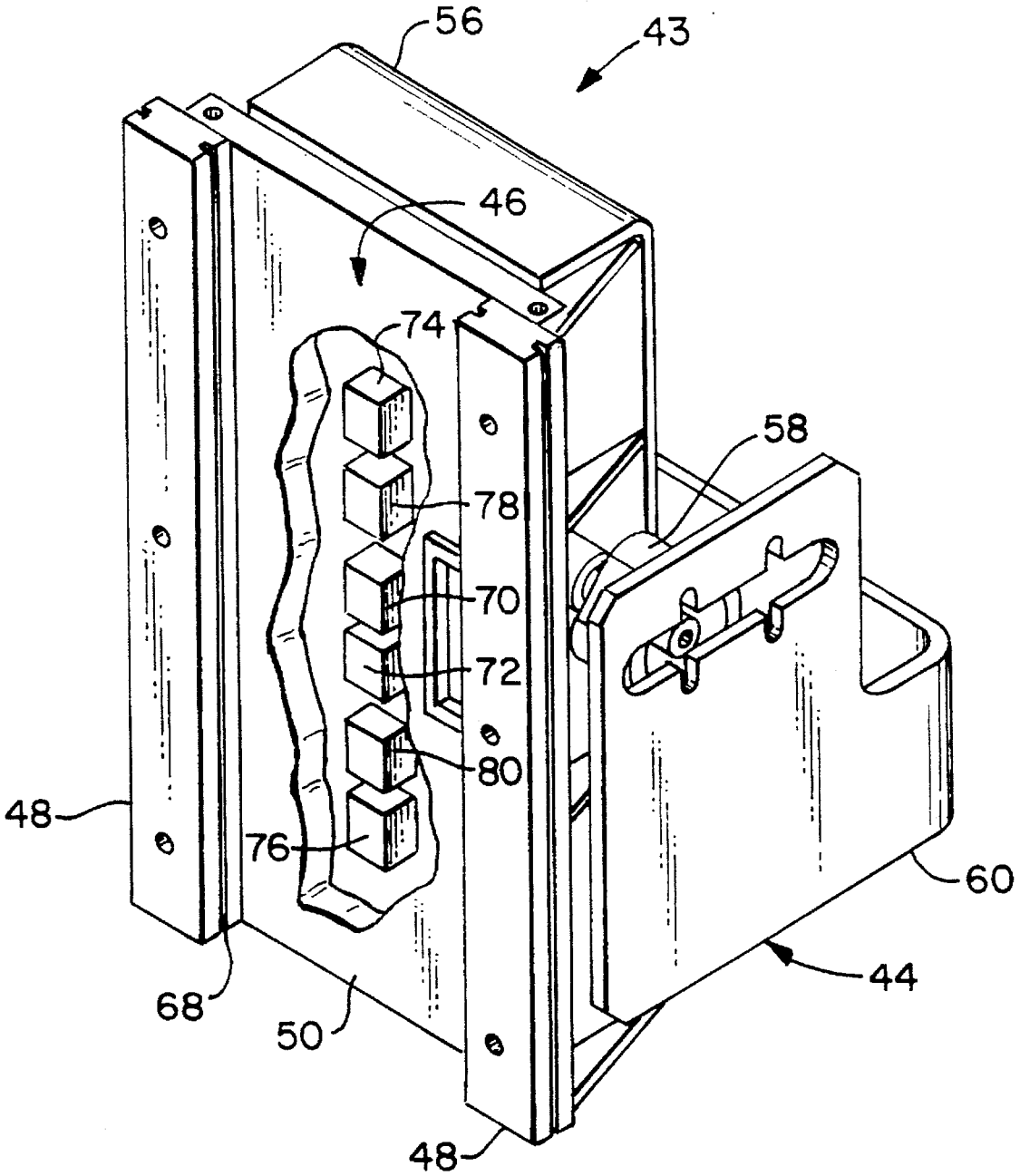
FIG. 4 is a sectional view of a preferred embodiment of the reader box of FIG. 2.
Figure 5:
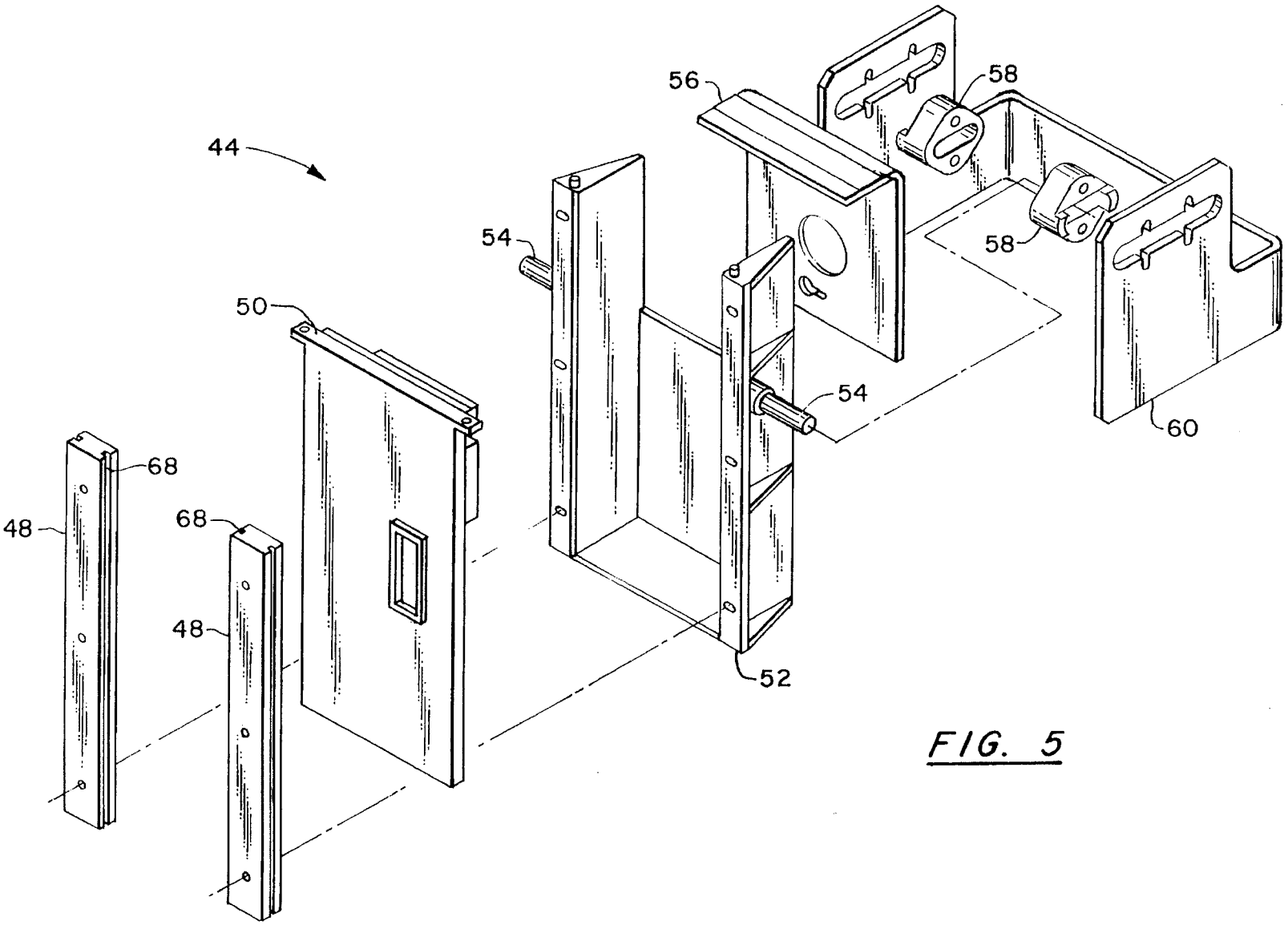
FIG. 5 is an exploded view of the reader box of FIG. 4.

Referring to FIG. 4, the decoding means 43 includes a reader box 44 and sensors 46 contained therein. In a preferred embodiment, the reader box 44 includes guides 48, a from cover 50, a housing 52, pins 54, rear cover 56, channel guides 58, a channel 60 and sensors 46. FIG. 5 is a perspective view of the reader box 44 exploded forward to illustrate the assembly of a preferred embodiment of the reader box 44. The reader box 44 moves the sensors 46 along the encoded medium 28 as the elevator travels in a vertical direction. Thus, referring again to FIG. 2, the channel 60 of the reader box 44 is attached to an angle bracket 62 which is attached to mounting channels 64 which in turn are attached to the crosshead 66 of the elevator car 12. As a result, the reader box 44 moves with the elevator car 12 as the elevator car 12 moves up and down the hoistway 14.

Referring again to FIGS. 4 and 5, to facilitate the vertical movement of the reader box 44 along the encoded medium 28, each guide 48 has a longitudinal groove 68 defining an area formed therein such that the groove 68 is adapted to receive and retain the outer edges 30 of the encoded medium 28. As the elevator travels in a vertical direction, the reader box 44 travels in the same vertical direction with the outer edges 30 of the steel tape 29 traversing through the grooves 68 formed in the guides 48. Thus, a constant distance between the front cover 50 and the steel tape 29 is maintained as the reader box 44 travels in a vertical direction. It should be understood to one skilled in the art that other various reader boxes can be used for vertically moving the sensors 46 along the encoded medium 28.

The reader box 44 contains sensors 46 that detect the encoding embodied in the encoded medium 28. In a preferred embodiment, the sensors 46 are hall effect devices which produce an electrical output signal when placed in close proximity to the magnets 42. The sensors 46 are disposed in the reader box 44 on the opposite side of the front plate as compared to the guides 48. The sensors 46 are disposed in the same vertical plane as the magnets 42 so that the sensors 46 detect the location of each magnet 42 as the elevator car 12 and the reader box 44 travels up and down the hoistway 14.

The reader box 44 contains first and second door zone sensors 70, 72 which are used to determine if the elevator car 12 is within a door zone. Preferably, the vertical distance between the first and second door zone sensors 70, 72 is minimal. If the length of the magnet 42 is 165 mm, as described above, then the distance between the sensors 70, 72 is less then 165 mm so that as the reader box 44 passes over the magnet 42 both sensors 70, 72 may simultaneously detect the same magnet 42. For example, a distance between the door zone sensors 70, 72 of 4 mm is used in a preferred embodiment.

The reader box 44 also contains level sensors which are ordinarily used to determine if the elevator is level with respect to a landing. In a preferred embodiment, the level sensors includes up and down sensors 74, 76. The present invention utilizes this set of sensors 74, 76 to assist in door zone detection as is described hereinbelow. However, it should be understood by one of ordinary skill in the art that sensors other than the level sensors may be used to assist in door zone detection. The vertical distance between the up and down sensors 74, 76 is chosen as a function of the length of the magnet 42. If the length of the magnet 42 is 165 mm, as described above, then the distance between the sensors 74, 76 is less then 165 mm so that as the reader box 44 passes over the magnet 42 both sensors 74, 76 may simultaneously detect the same magnet 42. In one preferred embodiment, the distance between the up and down sensors 74, 76 is 152 mm.

In another embodiment of the present invention, first and second position loss recovery sensors 78, 80 are disposed within the reader box 44. The position loss recovery sensors 78, 80 are ordinarily used in the event of a elevator system power failure. The present invention utilizes this set of sensors 78, 80 to assist in door zone detection as is described hereinbelow. However, it should be understood by one of ordinary skill in the art that sensors other than the position loss recovery sensors 78, 80 may be used to assist in door zone detection. The vertical distance between the first and second position loss recovery sensors 78, 80 is chosen as a function of the length of the magnet 42. If the length of the magnet 42 is 165 mm, as described above, then the distance between the sensors 78, 80 is less then 165 mm so that as the reader box 44 passes over the magnet 42 both sensors 78, 80 may simultaneously detect the same magnet 42. In one preferred embodiment, the distance between the first and second position loss recovery sensors 78, 80 is 45 mm.

Figure 6:
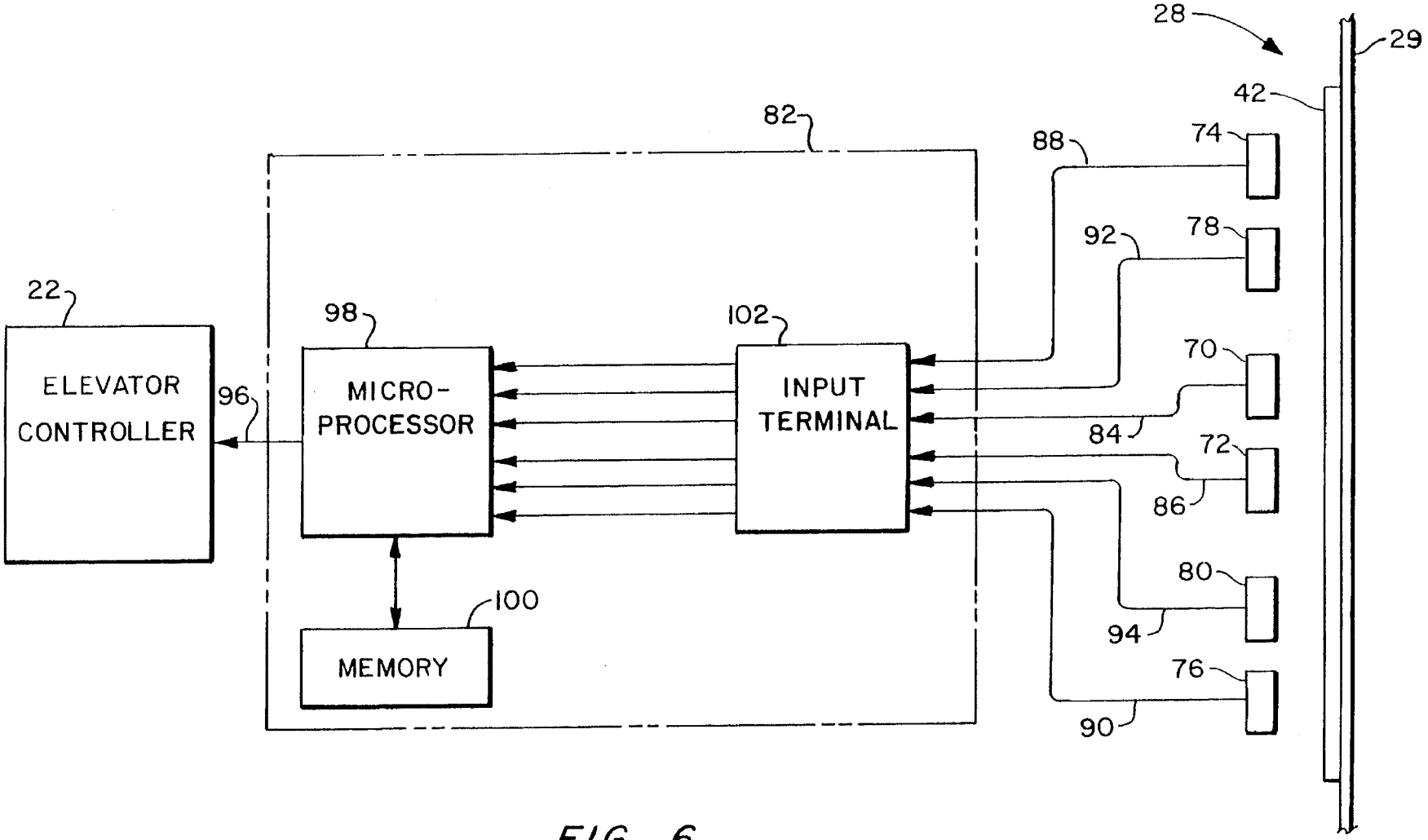
FIG. 6 is a functional block diagram of a preferred embodiment of the present invention.

FIG. 6 illustrates the first and second door zone sensors 70, 72, the up and down sensors 74, 76, the first and second position loss recovery sensors 78, 80, an encoded medium 28, a motion logic controller 82 and an elevator controller 22.

The sensors 46 are hall effect devices, as described above, which provide sensor signals in response to the magnets 42 of the encoded medium 28 such that the first door zone sensor 70 provides a first door zone sensor signal 84, the second door zone sensor 72 provides a second door zone sensor signal 86, the up sensor 74 provides a up sensor signal 88, the down sensor 76 provides a down sensor signal 90, the first position loss recovery sensor 78 provides a first position loss recovery sensor signal 92 and the second position loss recovery sensor 80 provides a second position loss recovery sensor signal 94. The value of each of the signals is a function of whether the sensor is placed in close proximity to the magnets 42. For example, the first door zone sensor 70 provides the first door zone sensor signal 84 with a value representative of a logic "1" if the first door zone sensor 70 is in close proximity to the magnet 42. Conversely, the first door zone sensor 70 provides the first door zone sensor signal 84 with a value representative of a logic "0" if the first door zone sensor 70 is not in close proximity to the magnet 42. Thus, the sensors 46 provide a means to decode the encoded medium 28. It should be understood by one skilled in the art that other sensors which provide substantially the function such as optical, inductive or mechanical sensors may be used with the present invention.

The motion logic controller 82 determines if an elevator car 12 is positioned within the door zone by analyzing the sensor signals and provides a door zone signal 96 to the elevator controller 22 as is explained hereinbelow. The motion logic controller 82 includes a microprocessor 98, memory 100, programming embedded in the memory 100 and an input terminal 102. The microprocessor 98, in a preferred embodiment, is an INTEL 80C186EC and is electrically connected to the input terminal 102, the memory 100 and the elevator controller 22 (shown in FIG. 1 ). The input terminal 102 is electrically connected to the sensors 46 by the traveling cable 26 (shown in FIG. 1 ). In a preferred embodiment, the motion logic controller 82 is disposed in the elevator controller 22.

The elevator position apparatus operates as follows. As the reader box 44 travels up and down the hoistway 14, the sensors 46 provide the sensor signals which are transmitted by the sensors 46 through the traveling cable 26 (shown in FIG. 1 ) to the input terminal 102. The input terminal 102 transmits the sensor signals to the microprocessor 98. The microprocessor 98 accesses the programming embedded in the memory 100 such that the microprocessor 98 operates according to the following algorithm:

Door Zone=(1LV and 2LV) or [(1LV or 2LV) and (UIS and DIS)], wherein Door Zone equals the value of the door zone signal 96 which is indicative of the presence of the door zone; 1LV equals the value of the first door zone sensor signal 84; 2LV equals the value of the second door zone sensor signal 86; UIS equals the value of the up sensor signal 88; and DIS equals the value of the down sensor signal 90.

The value of the door zone signal 96 is indicative of whether the elevator car 12 is within the door zone. For example, if the value of the door zone signal 96 is a logic "1" then the motion logic controller 82 has determined that the elevator car 12 is within the door zone. Conversely, if the value of the door zone signal 96 is a logic "0" then the motion logic controller 82 has determined that the elevator car 12 is not within the door zone. The microprocessor 98 determines the value of the door zone signal 96 and transmits the door zone signal 96 to the elevator controller 22.

In an alternative embodiment of the present invention, the microprocessor 98 operates according to the following algorithm:

Door Zone=(1LV and 2LV) or [(1LV or 2LV) and ((UIS and DIS) or (PR1 and PR2))], wherein Door Zone equals the value of the door zone signal 96 which is indicative of the presence of the door zone; 1LV equals the value of the first door zone sensor signal 84; 2LV equals the value of the second door zone sensor signal 86; UIS equals the value of the up sensor signal 88; and DIS equals the value of the down sensor signal 90; PR1 equals the value of the first position loss recovery signal 92 and PR2 equals the value of the second position loss recovery signal 94.

The present invention solves the problem of a failure to detect the presence of the door zone under sensor failure conditions. For example, if only two door zone sensors connected to an AND gate are used to detect the presence of the door zone and one of the sensors malfunctions in an inactive state then the elevator system never detects a valid door zone. Instead, the elevator car runs up and down the hoistway attempting to determine its position by finding a door zone where both sensors are actuated. This results in passenger entrapment because the elevator doors are disabled if a door zone is not detected. Furthermore, if the elevator system cannot detect a valid door zone then elevator "down-time" results which requires immediate servicing.

The present invention, however, allows the elevator system 10 to validate the existence of a door zone even under door zone sensor failure conditions; thus allowing the elevator car 12 to continue to operate without passenger entrapment. For example, if the motion logic controller 82 determines that the elevator car 12 is within the door zone despite that one of the door zone sensors has not detected one of the magnets 42, the motion logic controller 82 will log the inactive sensor in memory 100 as failed and continue normal operation of the elevator car 12. Once the sensor is logged as failed it may be identified and repaired by service personnel. The present invention also maintains the advantage of using two door zone sensors which protects against a false door zone detection in the event that one door zone sensor fails in an active state.

Thus, the present invention provides the advantage of a reduced number of passenger entrapments caused by the inability to detect a door zone. Additionally, the present invention provides improved failure management and reduced elevator downtime caused by door zone detection errors. Finally, the present invention facilitates scheduled maintenance by allowing service personnel to identify failed sensors and schedule maintenance without incurring significant down-time.

Various changes to the above description may be made without departing from the spirit and scope of the present invention as would be obvious to one of ordinary skill in the art of the present invention.

What is claimed is:

1. An elevator position apparatus for determining if an elevator car is positioned within a door zone, said apparatus comprising:

an encoded medium disposed vertically in an elevator hoistway;

at least two door zone sensors for providing first and second door zone sensor signals in response to said encoded medium;

at least two leveling sensors for providing up and down sensor signals in response to said encoded medium; and means for determining if the elevator car is positioned within the door zone, said means responsive to the first and second door zone sensor signals and the up and down sensor signals, said means operates in accordance with the following algorithm:

Door Zone=(1LV and 2LV) or [(1LV or 2LV) and (UIS and DIS)], wherein Door Zone equals the value of a door zone signal which is indicative of the presence of the door zone; 1LV equals the value of the first door zone sensor signal; 2LV equals the value of the second door zone sensor signal; UIS equals the value of the up sensor signal; and DIS equals the value of the down sensor signal.

2. An elevator position apparatus for determining if an elevator car is positioned within a door zone as recited in claim 1, wherein said encoded medium comprises a steel tape disposed vertically in the elevator hoistway.

3. An elevator position apparatus for determining if an elevator car is positioned within a door zone as recited in claim 2, wherein said encoded medium further comprises magnets disposed on said steel tape.

4. An elevator position apparatus for determining if an elevator car is positioned within a door zone as recited in claim 1, further comprising at least two position loss recovery sensors for providing first and second position loss recovery sensor signals wherein said means implements the following algorithm:

Door Zone=(1LV and 2LV) or [(1LV or 2LV) and ((UIS and DIS) or (PR1 and PR2))], wherein Door Zone equals the value of a door zone signal which is indicative of the presence of the door zone; 1LV equals the value of the first door zone sensor signal; 2LV equals the value of the second door zone sensor signal; UIS equals the value of the up sensor signal; and DIS equals the value of the down sensor signal; PR1 equals the value of the first position loss recovery sensor signal and PR2 equals the value of the second position loss recovery sensor signal.

5. An elevator position apparatus for determining if an elevator car is positioned within a door zone as recited in claim 4, wherein said encoded medium comprises a steel tape disposed vertically in the elevator hoistway.

6. An elevator position apparatus for determining if an elevator car is positioned within a door zone as recited in claim 5, wherein said encoded medium further comprises magnets disposed on said steel tape.

7. An elevator position apparatus for determining if an elevator car is positioned within a door zone, said apparatus comprising:

an encoded medium disposed vertically in an elevator hoistway;

decoding means for providing first and second door zone sensor signals and up and down sensor signals in response to said medium;

means for determining if the elevator car is positioned within the door zone, said means responsive to the first and second door zone sensor signals and the up and down sensor signals, said means operates in accordance with the following algorithm:

Door Zone=(1LV and 2LV) or [(1LV or 2LV) and (UIS and DIS)], wherein Door Zone equals the value of a door zone signal which is indicative of the presence of the door zone; 1LV equals the value of the first door zone sensor signal; 2LV equals the value of the second door zone sensor signal; UIS equals the value of the up sensor signal; and DIS equals the value of the down sensor signal.

8. An elevator position apparatus for determining if an elevator car is positioned within a door zone as recited in claim 7, wherein said encoded medium comprises a steel tape disposed vertically in the elevator hoistway.

9. An elevator position apparatus for determining if an elevator car is positioned within a door zone as recited in claim 8, wherein said encoded medium further comprises magnets disposed on said steel tape.

10. An elevator position apparatus for determining if an elevator car is positioned within a door zone, said apparatus comprising:

an encoded medium disposed vertically in an elevator hoistway;

decoding means for providing first and second door zone sensor signals up and down sensor signals, and first and second position loss recovery signals in response to said medium;

means for determining if the elevator car is positioned within the door zone, said means responsive to the first and second door zone sensor signals, the up and down sensor signals, and the first and second position loss recovery signals, said means operates in accordance with the following algorithm:

Door Zone=(1LV and 2LV) or [(1LV or 2LV) and ((UIS and DIS) or (PR1 and PR2))], wherein Door Zone equals the value of a door zone signal which is indicative of the presence of the door zone; 1LV equals the value of the first door zone sensor signal; 2LV equals the value of the second door zone sensor signal; UIS equals the value of the up sensor signal; and DIS equals the value of the down sensor signal; PR1 equals the value of the first position loss recovery sensor signal and PR2 equals the value of the second position loss recovery sensor signal.

11. An elevator position apparatus for determining if an elevator car is positioned within a door zone as recited in claim 10, wherein said encoded medium comprises a steel tape disposed vertically in the elevator hoistway.

12. An elevator position apparatus for determining if an elevator car is positioned within a door zone as recited in claim 11, wherein said encoded medium further comprises magnets disposed on said steel tape.

13. An elevator position apparatus for determining if an elevator car is positioned within a door zone, said apparatus comprising:

an encoded medium disposed vertically in an elevator hoistway;

at least two door zone sensors for providing first and second door zone sensor signals in response to said encoded medium;

at least two leveling sensors for providing up and down sensor signals in response to said encoded medium; and a motion logic controller for determining if the elevator car is positioned within the door zone, said motion logic controller responsive to the first and second door zone sensor signals and the up and down sensor signals, said motion logic controller operates in accordance with the following algorithm:

Door Zone=(1LV and 2LV) or [(1LV or 2LV) and (UIS and DIS)], wherein Door Zone equals the value of a door zone signal which is indicative of the presence of the door zone; 1LV equals the value of the first door zone sensor signal; 2LV equals the value of the second door zone sensor signal; UIS equals the value of the up sensor signal; and DIS equals the value of the down sensor signal.

14. An elevator position apparatus for determining if an elevator car is positioned within a door zone as recited in claim 13, wherein said encoded medium comprises a steel tape disposed vertically in the elevator hoistway.

15. An elevator position apparatus for determining if an elevator car is positioned within a door zone as recited in claim 14, wherein said encoded medium further comprises magnets disposed on said steel tape.

16. An elevator position apparatus for determining if an elevator car is positioned within a door zone, said apparatus comprising:

an encoded medium disposed vertically in an elevator hoistway;

decoding means for providing first and second door zone sensor signals, up and down sensor signals, and first and second position loss recovery signals in response to said medium;

a motion logic controller for determining if the elevator ear is positioned within the door zone, said motion logic controller responsive to the first and second door zone sensor signals, the up and down sensor signals, and the first and second position loss recovery signals, said motion logic controller operates in accordance with the following algorithm:

Door Zone=(1LV and 2LV) or [(1LV or 2LV) and ((UIS and DIS) or (PR1 and PR2))], wherein Door Zone equals the value of a door zone signal which is indicative of the presence of the door zone; 1LV equals the value of the first door zone sensor signal; 2LV equals the value of the second door zone sensor signal; UIS equals the value of the up sensor signal; and DIS equals the value of the down sensor signal; PR1 equals the value of the first position loss recovery sensor signal and PR2 equals the value of the second position loss recovery sensor signal.

17. An elevator position apparatus for determining if an elevator car is positioned within a door zone as recited in claim 16, wherein said encoded medium comprises a steel tape disposed vertically in the elevator hoistway.

18. An elevator position apparatus for determining if an elevator car is positioned within a door zone as recited in claim 17, wherein said encoded medium further comprises magnets disposed on said steel tape.

* * * * *